US008316661B2

(12) United States Patent
Choi

(10) Patent No.: US 8,316,661 B2
(45) Date of Patent: Nov. 27, 2012

(54) ICE MAKING DEVICE FOR REFRIGERATOR

(75) Inventor: Chang-Bong Choi, Chsngwon (KR)

(73) Assignee: LG Electronics Inc., Seoul (KR)

( * ) Notice: Subject to any disclaimer, the term of this patent is extended or adjusted under 35 U.S.C. 154(b) by 1156 days.

(21) Appl. No.: 12/162,459

(22) PCT Filed: Feb. 12, 2007

(86) PCT No.: PCT/KR2007/000753

§ 371 (c)(1),
(2), (4) Date: Jul. 28, 2008

(87) PCT Pub. No.: WO2007/091875

PCT Pub. Date: Aug. 16, 2007

(65) Prior Publication Data

US 2009/0000330 A1 Jan. 1, 2009

(30) Foreign Application Priority Data

Feb. 10, 2006 (KR) ..... 10-2006-0013271

(51) Int. Cl.

| | |
|---|---|
| ***F25C 5/18*** | (2006.01) |
| ***F25C 1/00*** | (2006.01) |
| ***F25C 1/22*** | (2006.01) |
| ***F25D 23/12*** | (2006.01) |
| ***A23G 9/00*** | (2006.01) |

(52) U.S. Cl. ..... 62/344; 62/337; 62/347; 62/345; 62/340

(58) Field of Classification Search ..... 62/340, 62/337–338, 377, 347, 345
See application file for complete search history.

(56) References Cited

U.S. PATENT DOCUMENTS

| | | | | | |
|---|---|---|---|---|---|
| 5,156,021 | A * | 10/1992 | St-Gelais et al. | ..... | 62/382 |
| 5,904,054 | A * | 5/1999 | Lee | ..... | 62/347 |
| 6,050,097 | A | 4/2000 | Nelson et al. | | |
| 6,442,954 | B1 | 9/2002 | Shapiro et al. | | |
| 7,249,922 | B2 * | 7/2007 | Yoneoka | ..... | 411/45 |

FOREIGN PATENT DOCUMENTS

| | | | |
|---|---|---|---|
| JP | 3-158672 | * | 8/1991 |
| JP | 404257677 A | * | 9/1992 |
| KR | 1992-0020174 A | | 11/1992 |
| KR | 10-1996-0008178 | | 6/1996 |
| KR | 10-0197906 B1 | | 6/1999 |
| KR | 10-0539562 B1 | | 12/2005 |
| WO | WO 2005/026631 | * | 3/2005 |

* cited by examiner

*Primary Examiner* — Frantz Jules
*Assistant Examiner* — Cassey D Bauer
(74) *Attorney, Agent, or Firm* — Birch, Stewart, Kolasch & Birch, LLP

(57) ABSTRACT

The present invention provides an ice making device for a refrigerator, which is installed in a storage space of the refrigerator to make ice by cold air circulating through the storage space. The ice making device comprises a water tank which is installed within an ice making space provided in a receiving box installed to be introduced into and taken out from the storage space, and has a water-storing space for storing water to be used in making ice and at least one water-supplying hole for use in supplying the water stored in the water-storing space; and at least one ice tray installed in the ice making space and provided with at least one ice making recess for use in making ice by receiving the water stored in the water-storing space. The water stored in the water tank is supplied to the ice tray when the water tank is mounted in the storage space.

17 Claims, 5 Drawing Sheets

ICE MAKING DEVICE FOR REFRIGERATOR

TECHNICAL FIELD

The present invention relates to a refrigerator, and more particularly, to an ice making device for a refrigerator, which is provided in the refrigerator to make ice.

BACKGROUND ART

A refrigerator is an electric home appliance for freezing or refrigerating foods to keep them in a fresh state for a long time. Generally, a refrigerator is provided with a freezing chamber and a refrigerating chamber, and an ice making device for making ice is installed in the freezing chamber. Such an ice making device includes an ice tray for malting ice using supplied water, and an ice bank for storing the ice made in the ice tray.

According to a conventional ice making device thus constructed, an ice tray is removed from a freezing chamber and supplied with water and then installed again in the freezing chamber. When the water contained in the ice tray is frozen by cold air flowing through the freezing chamber and ice is completely made, the ice is separated therefrom by twisting the ice tray. The separated ice is stored in an ice bank, and the stored ice is used by taking out the ice bank from the freezing chamber or a rear side of a freezing chamber door.

However, such a conventional ice making device for a refrigerator has the following problems.

As described above, according to the conventional ice making device, the ice tray should be removed from the freezing chamber and supplied with water and then installed again in the freezing chamber. Hence, there is a disadvantage in that a process of filling the ice tray with water is complicated.

Furthermore, in the process of installing the ice tray filled with water to the freezing chamber, the contained water may be splashed to the outside. Hence, there is a possibility that the freezing chamber will be soiled.

Moreover, in the process of filling the ice tray with water, water may penetrate into a rotation mechanism for twisting the ice tray. Hence, the water that has penetrated into the rotation mechanism is frozen, and thus, the rotation of the ice tray may be interrupted.

DISCLOSURE

Technical Problem

Accordingly, the present invention is conceived to solve the aforementioned problems in the prior art. An object of the present invention is to provide an ice making device for a refrigerator, which is configured to more simply fill an ice tray with water.

Another object of the present invention is to provide an ice making device for a refrigerator, which is configured to prevent water contained in an ice tray from being splashed to the outside.

A further object of the present invention is to provide an ice making device for a refrigerator, which is configured to operate more accurately.

Technical Solution

According to an aspect of the present invention for achieving the objects, there is provided an ice making device for a refrigerator, the ice making device being installed in a storage space of the refrigerator to make ice by cold air circulating through the storage space, the ice making device comprising: a water tank installed within an ice making space provided in a receiving box that is installed to be introduced into and taken out from the storage space, the water tank having a water-storing space for storing water to be used in making ice and at least one water-supplying hole for use in supplying the water stored in the water-storing space; and at least one ice tray installed in the ice making space and provided with at least one ice making recess for use in malting ice by receiving the water stored in the water-storing space, wherein the water stored in the water tank is supplied to the ice tray when the water tank is mounted in the storage space.

In one embodiment of the invention, the water tank is installed in the ice making space such that the water tank can be detachably attached in a vertical direction, and the ice tray is installed in the ice making space below the water tank such that the ice tray can be introduced into and taken out from the ice making space in a fore and aft direction.

In another embodiment of the invention, the water tank is supported by a support plate provided in the ice making space.

In another embodiment of the invention, the water tank comprises: a tank body having the water-storing space and the water-supplying hole; a tank cover for selectively opening and closing the water-storing space; and a valve for selectively opening and closing the water-supplying hole.

In another embodiment of the invention, the valve comprises: a valve body installed on a bottom surface of the tank body so as to move in a vertical direction; at least one valve protrusion provided in the valve body such that an upper end of the valve protrusion penetrates through the bottom surface of the tank body and is then positioned within the water-storing space; at least one valve cap provided on the upper end of the valve protrusion positioned within the water-storing space so as to selectively open and close the water-supplying hole; and an elastic member for imparting an elastic force to the valve body, the elastic force being applied in a direction for closing the water-supplying hole by the valve cap, and wherein when the water tank is mounted in the storage space, the valve is moved while overcoming the elastic force of the elastic member and then opens the water-supplying hole.

In another embodiment of the invention, the water supplied to the ice tray through the water-supplying hole is transferred to the ice tray through a water-supplying opening that is formed in a support plate provided in the ice making space to support the water tank.

In another embodiment of the invention, the water tank is mounted in the ice making space, the valve opens the water-supplying hole while being moved in the vertical direction by a driving unit provided on a support plate that is provided in the ice making space to support the water tank.

In another embodiment of the invention, corresponding portions of the driving unit and the valve are provided respectively with a driving boss and a driving protrusion that are formed to match with each other in shape such that one of them is inserted into the other thereof.

In another embodiment of the invention, corresponding portions of the driving boss and the driving protrusion are provided respectively with a guide slit and a guide rib for guiding the insertion between the driving boss and the driving protrusion.

In another embodiment of the invention, the guide slit is formed by cutting out a portion of an outer peripheral surface of the driving boss in a lengthwise direction thereof, and the guide rib is formed by radially extending a portion of an outer peripheral surface of the driving protrusion.

In another embodiment of the invention, there is further comprising a fixing means for preventing the water tank from being inadvertently released from a state where the water tank is mounted in the ice making space.

In another embodiment of the invention, the fixing means comprises: at least one fixing slot provided in one of the water tank and a support plate provided in the ice making space to support the water tank; and at least one fixing rib provided in the other of the water tank and the support plate so as to be inserted into the fixing slot.

In another embodiment of the invention, the fixing means comprises: at least one locking protrusion provided in one of the water tank and a support plate provided in the ice making space to support the water tank; and at least one fixing hook provided in the other of the water tank and the support plate so as to be elastically coupled to the locking protrusion.

In another embodiment of the invention, the ice tray is rotatably installed on a support frame detachably attached in the ice making space.

In another embodiment of the invention, there is further comprising at least one tray cover for selectively opening and closing the ice making recess.

In another embodiment of the invention, the tray cover selectively opens and closes the ice making recess in such a manner that one end of the tray cover is pivoted on the other end thereof in response to rotation of the ice tray.

In another embodiment of the invention, the tray cover is provided with a water-supplying aperture for transferring water to be supplied to the ice tray through the water-supplying hole to the ice tray.

In another embodiment of the invention, a top surface of the tray cover is provided, in the vicinity of the water-supplying aperture, with a water-supplying guide for guiding the water to be supplied to the ice tray.

In another embodiment of the invention, there is further comprising an ice bank for storing ice made in the ice tray.

In another embodiment of the invention, the ice bank is installed to be introduced into and taken out from the ice making space below the ice tray.

According to another aspect of the present invention for achieving the objects, there is provided an ice making device for a refrigerator, the ice making device being installed to make ice by cold air circulating through a storage space of the refrigerator, the ice making device comprising: an ice making housing detachably installed in the storage space and provided with an ice making space; a water tank installed detachably in a vertical direction in the ice making space, the water tank storing water for use in making ice; a tray kit detachably installed in the ice making space so as to make ice with the water supplied from the water tank through a water-supplying hole when the water tank is mounted in the ice making space; and an ice bank installed to be introduced into and taken out from the ice making space, the ice bank storing the ice made in an ice tray.

In one embodiment of the invention, the water tank comprises: a tank body provided with a water-storing space for storing the water to be supplied to the ice tray and at least one water-supplying hole for use in supplying the water stored in the water-storing space to the ice tray; a tank cover for selectively opening and closing the water-storing space; and a valve for selectively opening and closing the water-supplying hole.

In another embodiment of the invention, the valve comprises: a valve body installed on a bottom surface of the tank body so as to move in a vertical direction; at least one valve protrusion provided in the valve body such that an upper end of the valve protrusion penetrates through the bottom surface of the tank body and is then positioned within the water-storing space; at least one valve cap provided on the upper end of the valve protrusion positioned within the water-storing space so as to selectively open and close the water-supplying hole; and an elastic member for imparting an elastic force to the valve body, the elastic force being applied in a direction for closing the water-supplying hole by the valve cap.

In another embodiment of the invention, a support plate for supporting the water tank is provided within the ice making space, and the support plate is provided with at least one water-supplying opening for transferring the water to be supplied to the ice tray through the water-supplying hole, and a driving unit for opening the water-supplying hole by moving the valve upwardly.

In another embodiment of the invention, one of the driving unit and the valve is provided with a driving boss, the other of the driving unit and the valve is provided with a driving protrusion, and the driving protrusion is inserted into the driving boss in a process of driving the valve by the driving unit.

In another embodiment of the invention, the driving boss is provided with a guide slit formed by cutting out a portion of an outer peripheral surface of the driving boss, the driving protrusion is provided with a guide rib formed by radially extending a portion of an outer peripheral surface of the driving protrusion, and the guide rib is inserted into the guide slit so as to guide the insertion of the driving protrusion into the driving boss.

In another embodiment of the invention, one of the water tank and a support plate provided in the ice making space to support the water tank is provided with at least one fixing slot and a locking protrusion, the other of the water tank and the support plate is provided with at least one fixing rib and a fixing hook, and when the water tank is mounted in the ice making space, the fixing rib is inserted into the fixing slot and the fixing hook is elastically coupled to the locking protrusion, so that the water tank is prevented from being inadvertently separated.

In another embodiment of the invention, the tray kit comprises: a support frame detachably installed in the ice making space; and at least one ice tray rotatably installed on the support frame and provided with a plurality of ice making recesses for use in making ice with the water supplied from the water tank.

In another embodiment of the invention, there is further comprising at least one tray cover for selectively opening and closing the ice making recesses in such a manner that one end of the tray cover is pivoted on the other end thereof in response to rotation of the ice tray.

In another embodiment of the invention, the tray cover comprises: a water-supplying aperture for transferring the water to be supplied to the ice tray through the water-supplying hole to the ice tray; and a water-supplying guide for guiding the water to be supplied to the ice tray through the water-supplying hole.

In another embodiment of the invention, the ice making housing is installed in a receiving space provided in a receiving box that is installed to be introduced into and taken out from the storage space.

In another embodiment of the invention, the ice making housing is formed integrally with the receiving box.

In another embodiment of the invention, the ice making housing is provided with at least one cold air supply opening for causing cold air circulating through the storage space to flow into the ice making space.

Advantageous Effects

According to the present invention thus constructed, there are advantages in that it is possible to more simply and cleanly use the ice tray and the operational reliability of a product is improved.

BEST MODE

Hereinafter, preferred embodiments of an ice making device for a refrigerator according to the present invention will be described in detail with reference to the accompanying drawings.

Figure 1:
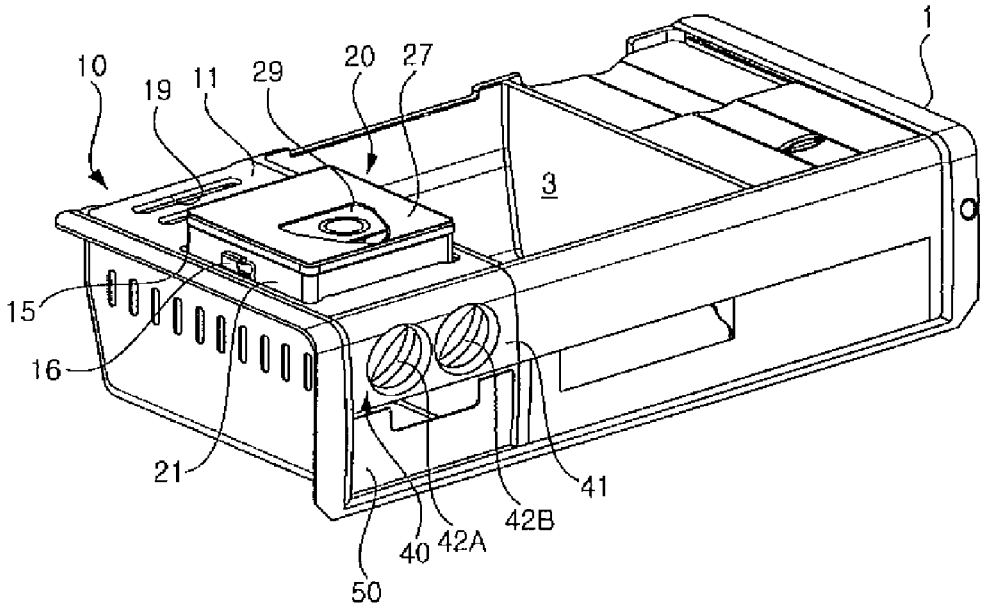
FIG. 1 is a perspective view illustrating an ice making device for a refrigerator according to a preferred embodiment of the present invention.
Figure 2:
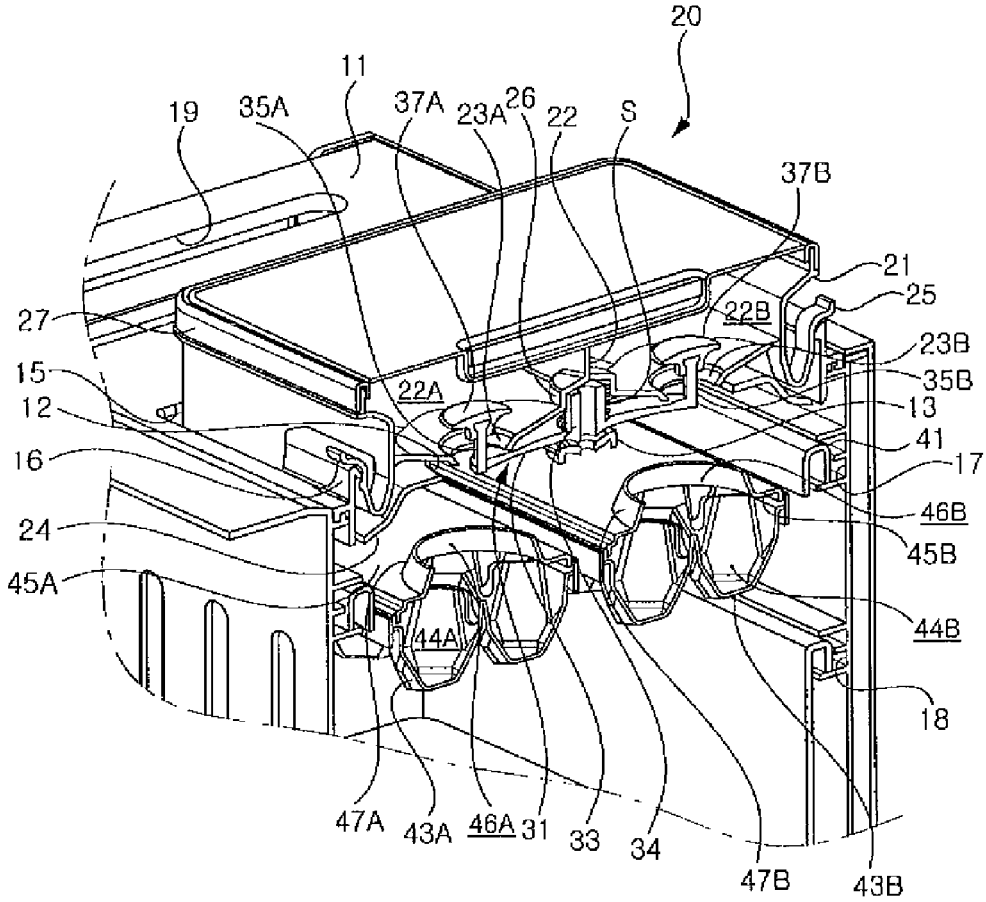
FIG. 2 is a partially cut-away perspective view illustrating main parts in the preferred embodiment of the present invention.
Figure 3:
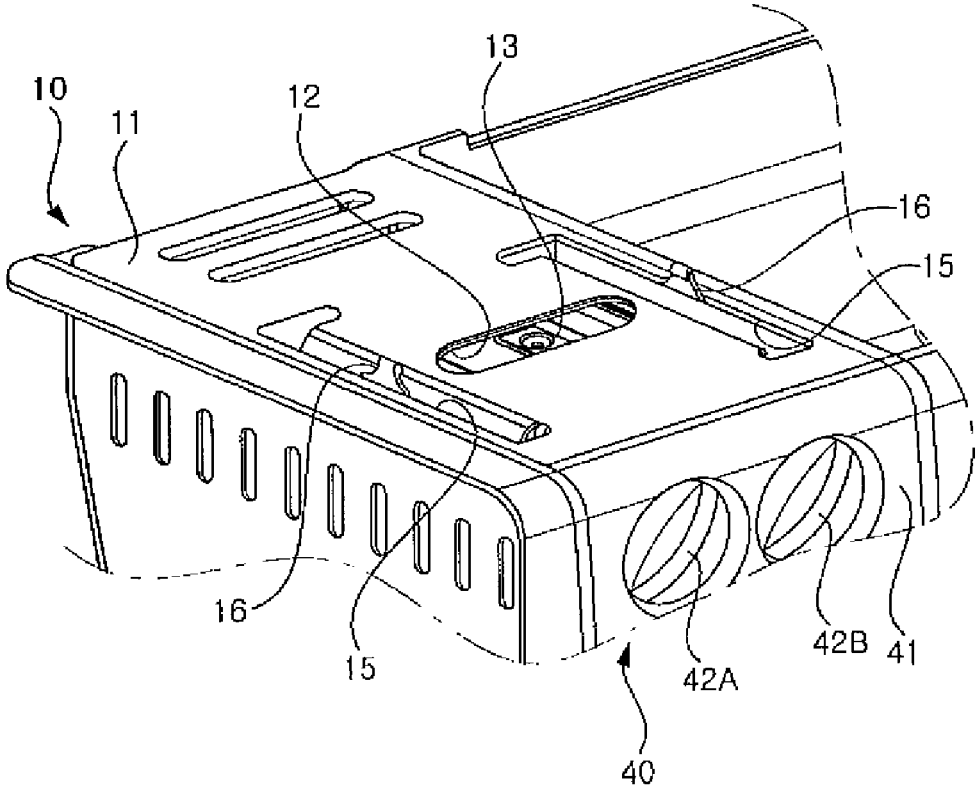
FIG. 3 is a perspective view illustrating an upper portion of a receiving box in the preferred embodiment of the present invention.
Figure 4:
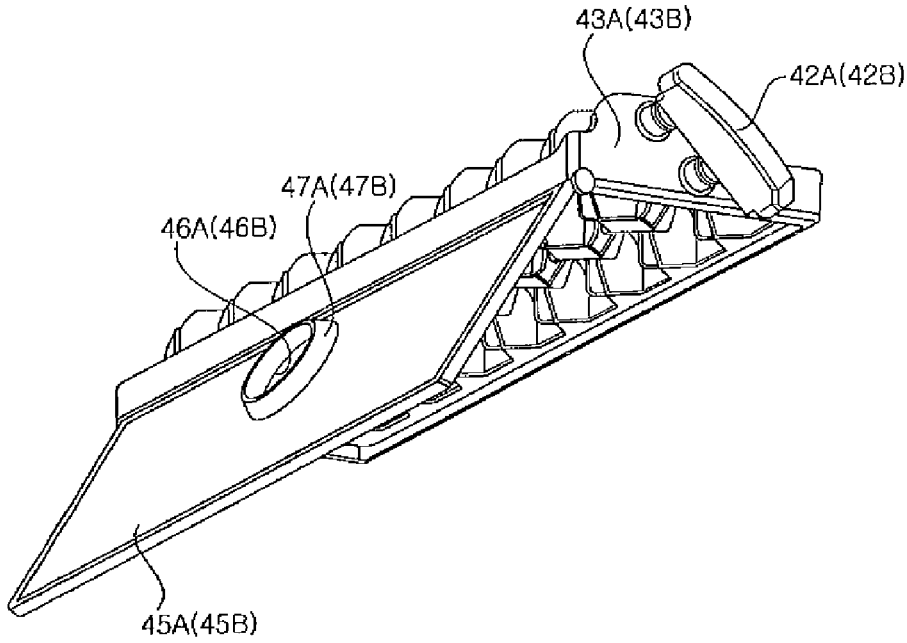
FIG. 4 is a perspective view illustrating an ice tray and a tray cover in the preferred embodiment of the present invention.

FIG. 1 is a perspective view illustrating an ice making device for a refrigerator according to a preferred embodiment of the present invention, FIG. 2 is a partially cut-away perspective view illustrating main parts in the preferred embodiment of the present invention, FIG. 3 is a perspective view illustrating an upper portion of a receiving box in the preferred embodiment of the present invention, and FIG. 4 is a perspective view illustrating an ice tray and a tray cover in the preferred embodiment of the present invention.

As illustrated in the figures, an ice making device for a refrigerator according to the present invention includes an ice making housing 10, a water tank 20, a tray kit 40 and an ice bank 50. The ice making device is installed in a storage space of the refrigerator, particularly, a freezing chamber, to make ice by cold air flowing through the freezing chamber and to store the ice so that a user can use the ice.

The interior of the ice making housing 10 is provided with an ice making space in which the water tank 20, the tray kit 40 and the ice bank 50 are installed. The ice making housing 10 is formed to have the shape of a hexahedron with an open front face. A top surface of the ice making housing 10 is defined by a support plate 11.

As illustrated in FIG. 3, the support plate 11 is provided with a water-supplying opening 12. The water-supplying opening 12 is to transfer water stored in the water tank 20 to ice trays 43A and 43B of the tray kit 40. The water-supplying opening 12 is formed by cutting out a central portion of the support plate 11 into a predetermined shape.

Furthermore, the support plate 11 is provided with a driving unit 13. The driving unit 13 is positioned within the water-supplying opening 12 so as to laterally divide the water-supplying opening 12. The driving unit 13 functions to drive a valve 31, which will be described later, in order to supply the water stored in the water tank 20 to the ice trays 43A and 43B.

The support plate 11 is provided with fixing slots 15 and locking protrusions 16. The fixing slots 15 are formed by cutting out both side ends of the support plate 11 corresponding to both sides of the water-supplying opening 12 into shapes of "ㄷ" facing each other. Each of the locking protrusions 16 is provided at one side of the support plate 11 adjacent to each of the fixing slots 15. The locking protrusions 16 protrude upwardly from the support plate 11 by a predetermined height. The fixing slots 15 and the locking protrusions 16 are to prevent the water tank 20 from being inadvertently removed from the ice making space in an installed state of the water tank in the ice making space.

Furthermore, as illustrated in FIG. 2, a pair of guide grooves 17 and 18 are formed on each of both inner side surfaces of the ice malting housing 10. The guide grooves 17 and 18 are formed to have an identical height and to be elongated in a fore and aft direction on each of the both inner side surfaces of the ice making housing 10. The guide grooves 17 and 18 are to guide operations for taking in and out the tray kit 40 and the ice bank 50, respectively. Hereinafter, a relatively upper guide groove of the guide grooves 17 and 18 is called a first guide groove 17, and a relatively lower guide groove of the guide grooves 17 and 18 is called a second guide groove 18.

Furthermore, the support plate 11 is provided with a plurality of cold air supply openings 19. The cold air supply openings 19 are to cause cold air circulating through the freezing chamber to flow into the ice making space. The cold air supply openings 19 are formed by cutting out a portion of the support plate 11, preferably a rear end of the support plate 11 adjacent to a rear surface of the freezing chamber.

In the illustrated embodiment, the ice making housing 10 is formed integrally with a receiving box 1 that is installed to be introduced into and taken out from the freezing chamber. That is, a portion of a receiving space 3 provided in the receiving box 1 is partitioned to form the ice making space. It will also be apparent that the ice making housing 10 may be formed separately from the receiving box 1 and then installed to be introduced into and taken out from the freezing chamber.

Referring back to FIG. 1, the water tank 20 is installed on a top surface of the support plate 11 such that the water tank can be installed thereon to be detachable in an up and down direction. In the illustrated embodiment, the water tank 20 is detachably installed substantially above the ice making space but not limited thereto. That is, if the support plate 11 were provided substantially within the ice making space, the water tank 20 would be installed within the ice making space. As specifically illustrated in FIG. 2, the water tank 20 includes a tank body 21, a tank cover 27, a valve 31 and a coil spring S.

The tank body 21 is formed to have the shape of a flat hexahedron with an open top face. Furthermore, as illustrated in FIG. 2, a water-storing space is provided in the tank body 21. The water-storing space stores water to be supplied to the ice trays 43A and 43B. In the illustrated embodiment, the water-storing space is divided into a first water-storing space 22A and a second-water storing space 22B by a partition rib 22 that is provided within the tank body 21. The first and second water-storing spaces are to separately store water to be supplied respectively to the ice trays 43A and 43B. That is, the water-storing space may be divided into a predetermined number of water-storing subspaces depending on the number of the ice trays 43A and 43B.

Furthermore, a first water-supplying hole 23A and a second water-supplying hole 23B are provided in a bottom surface of the tank body 21. The first and second water-supplying holes 23A and 23B are to supply the water stored in the first and second water-storing spaces 22A and 22B to the ice trays 43A and 43B, respectively. The first and second water-supplying holes 23A and 23B are formed by cutting out portions of the bottom surface of the tank body 21 such that they communicate with the first and second water-storing spaces 22A and 22B, respectively. The first and second water-supplying holes 23A and 23B communicate with the water-supplying opening 12.

Moreover, the bottom surface of the tank body 21 is provided with fixing ribs 24 and fixing hooks 25. The fixing ribs 24 are provided to have a "ㄷ"-shaped cross section, which corresponds to the fixing slots 15, at both side ends of the bottom surface and both ends of each of front and rear surfaces of the tank body 21. The fixing ribs 24 are inserted into the fixing slots 15 when the water tank 20 is mounted on the top surface of the support plate 11. Furthermore, each of the fixing hooks 25 is formed by upwardly bending one side of each of the fixing ribs 24 to have certain elasticity. The fixing hooks 25 are elastically coupled to the locking protrusions 16 when the water tank 20 is mounted on the top surface of the support plate 11.

In addition, a valve guide 26 is provided on the bottom surface of the tank body 21. The valve guide 26 is to guide the valve 31 that is moved in a vertical direction to selectively open and close the first and second water-supplying holes 23A and 23B. The valve guide 26 is formed by depressing a portion of the bottom surface of the tank body 21 upwardly, i.e., into the first and second water-storing spaces 22A and 22B.

The tank cover 27 is selectively coupled to a top surface of the tank body 21 so as to selectively open and close the first and second water-storing spaces 22A and 22B. The tank cover 27 is provided with a supply opening (not shown). The supply opening supplies water that is to be stored in the first and second water-storing spaces 22A and 22B and is formed by cutting out a portion of the tank cover 27. Furthermore, the tank cover 27 is provided with a supply opening cover 29 for selectively opening and closing the supply opening. The supply opening cover 29 is installed such that one end thereof can be pivoted in the vertical direction on the other end thereof. It will be apparent that the tank cover 27 is separated from the tank body 21 and water is stored in the first and second water-storing spaces 22A and 22B.

Meanwhile, the valve 31 functions to selectively open and close the first and second water-supplying holes 23A and 23B. The valve 31 is installed on the bottom surface of the tank body 21 so as to move in the vertical direction. The valve 31 includes a valve body 32, a pair of valve protrusions 35A and 35B, and valve caps 37A and 37B.

The valve body 32 is installed on the bottom surface of the tank body 21 so as to move in the vertical direction by the driving unit 13. A guide boss 34 is provided on a top surface of the valve body 32. The guide boss 34 is inserted into the valve guide 26 and is moved in the vertical direction along the valve guide 26.

Furthermore, the valve protrusions 35A and 35B are provided at both side ends of the valve body 32. The valve protrusions 35A and 35B extend upwardly at the both side ends of the valve body 32 so that upper ends thereof penetrate through the first and second water-supplying holes 23A and 23B and then are positioned within the first and second water-storing spaces 22A and 22B. Hereinafter, a valve protrusion of the valve protrusions 35A and 35B, which penetrates through the first water-supplying hole 23A, is called a first valve protrusion 35A, and a valve protrusion of the valve protrusions 35A and 35B, which penetrates through the second water-supplying hole 23B, is called a second valve protrusion 35B.

The valve caps 37A and 37B are respectively provided on the upper ends of the valve protrusions 35A and 35B, which penetrate through the first and second water-supplying holes 23A and 23B and are then positioned within the first and second water-storing spaces 22A and 22B. A valve cap of the valve caps 37A and 37B positioned at the upper end of the first valve protrusion 35A is called a first valve cap 37A, and a valve cap of the valve caps 37A and 37B positioned at the upper end of the second valve protrusion 35B is called a second valve cap 37B.

The first and second valve caps 37A and 37B function to selectively open and close the first and second water-supplying holes 23A and 23B, respectively. To this end, the first and second valve caps 37A and 37B are formed at least relatively larger than the first and second water-supplying holes 23A and 23B. Furthermore, if the valve 31 is moved in the vertical direction, the first and second valve caps 37A and 37B are selectively brought into contact with portions of the bottom surface of the tank body 21, which correspond to outer peripheries of the first and second water-supplying holes 23A and 23B, thereby selectively opening and closing the first and second water-supplying holes 23A and 23B.

The coil spring S imparts a certain elastic force to the valve 31 so that the valve 31 can be moved in a direction for closing the first and second water-supplying holes 23A and 23B. The coil spring S is installed to surround the guide boss 34, and both ends of the coil spring are supported by the bottom surface of the tank body 21 corresponding to the interior of the valve guide 26 and by the top surface of the valve body 32 adjacent to the guide boss 34.

The tray kit 40 functions to make ice from water supplied from the water tank 20, i.e., the first and second water-storing spaces 22A and 22B, and to transfer the ice to the ice bank 50. As illustrated in FIG. 2, the tray kit 40 includes a support frame 41, the pair of ice trays 43A and 43B, and tray covers 45A and 45B.

The support frame 41 is formed to have the shape of an approximately rectangular frame. The support frame 41 is received in and taken out from the ice malting space while both side ends thereof are guided by the first guide groove 17. A pair of manipulation levers 42A and 42B are provided on an outer front surface of the support frame 41. The manipulation levers 42A and 42B are manipulated by a user in order to rotate the ice trays 43A and 43B, respectively. Furthermore, although not illustrated, a pair of tray stoppers are provided on an inner rear surface of the support frame 41. The tray stoppers function to support the ice trays 43A and 43B such that the ice trays are maintained horizontally and simultaneously to cause the ice trays 43A and 43B to be twisted while coming into contact with one sides of the ice trays 43A and 43B that have been rotated by a predetermined angle.

The ice trays 43A and 43B include the first ice tray 43A and the second ice tray 43B. The first and second ice trays 43A and 43B are formed to have an approximately rectangular cross section. The first and second ice trays 43A and 43B are installed to be rotatable about rotational shafts (not shown) provided at front and rear ends of the support frame 41. Furthermore, the first and second ice trays 43A and 43B are provided with a plurality of ice making recesses 44A and 44B. The ice making recesses 44A and 44B make ice from water supplied from the first and second water-storing spaces 22A and 22B.

Meanwhile, the tray covers 45A and 45B function to selectively open and close the ice making recesses 44A and 44B.

To this end, the tray covers 45A and 45B are formed to have plate-like shapes corresponding to cross sections of the first and second ice trays 43A and 43B, respectively. Furthermore, the tray covers 45A and 45B are installed to one ends of the first and second ice trays 43A and 43B so that the one ends of the tray covers 45A and 45B can be pivoted in the vertical direction on the other ends thereof. Hereinafter, a tray cover covering the ice making recess 44A of the first ice tray 43A is called a first tray cover 45A, and a tray cover coveting the ice making recess 44B of the second ice tray 43B is called a second tray cover 45B.

The first and second tray covers 45A and 45B are provided with water-supplying apertures 46A and 46B, respectively. The water-supplying apertures 46A and 46B are formed by cutting out portions of the first and second tray covers 45A and 45B, which correspond to the first and second water-supplying holes 23A and 23B and the water-supplying opening 12, into a predetermined shape. The water-supplying apertures 46A and 46B are to transfer water to be supplied to the first and second ice trays 43A and 43B through the first and second water-supplying holes 23A and 23B and the water-supplying opening 12.

Furthermore, the first and second tray covers 45A and 45B are provided with water-supplying guides 47A and 47B, respectively. The water-supplying guides 47A and 47B are formed in such a manner that portions of top surfaces of the first and second tray covers 45A and 45B adjacent to the water-supplying apertures 46A and 46B protrude upwardly. The water-supplying guides 47A and 47B function to guide water to be transferred to the first and second ice trays 43*a* and 43B through the water-supplying apertures 46A and 46B.

Referring again to FIG. 1, the ice bank 50 is installed to be introduced into and taken out from a lower portion of the ice making space. Ice made in the first and second ice trays 43A and 43B is stored in the ice bank 50. That is, when the first and second ice trays 43A and 43B are twisted by a certain angle, ice made in the ice making recesses 44A and 44B is separated therefrom and is then stored in the ice bank 50. The ice bank 50 is formed to have the shape of a hexahedron with an open top face. Furthermore, although not illustrated, outer side surfaces of the ice bank 50 may be provided with guide ribs guided by the second guide grooves 18.

Hereinafter, a process of making ice by the ice making device for a refrigerator according to the preferred embodiment of the present invention will be described.

First, water is stored in the first and second water-storing spaces 22A and 22B of the water tank 20. At this time, a user can supply water to the first and second water-storing spaces 22A and 22B in a state where the supply opening is opened by separating the tank cover 27 from the tank body 21 or pivoting the supply opening cover 29.

When water is stored in the first and second water-storing spaces 22A and 22B, the water tank 20 is mounted on the top surface of the support plate 11. Furthermore, while the water tank 20 is mounted on the top surface of the support plate 11 downwardly from above, the fixing ribs 24 of the water tank 20 are inserted into the fixing slots 15 of the support plate 11. Moreover, the fixing hooks 25 of the water tank 20 are elastically coupled to the locking protrusions 16 of the support plate 11. Hence, the water tank 20 cannot be inadvertently separated in a state where it has been mounted on the top surface of the support plate 11.

Meanwhile, when the water tank 20 is mounted on the top surface of the support plate 11, the valve 31 is driven by the driving unit 13 so that the first and second water-supplying holes 23A and 23B are opened. More specifically, when the water tank 20 is mounted on the top surface of the support plate 11, the valve 31 is moved upwardly by the driving unit 13 while overcoming the elastic force of the coil spring S. Hence, the first and second valve caps 37A and 37B closing the first and second water-supplying holes 23A and 23B are moved upwardly, so that the first and second water-supplying holes 23A and 23B are opened.

Furthermore, when the first and second water-supplying holes 23A and 23B are opened, water stored in the first and second water-storing spaces 22A and 22B is supplied to the first and second ice trays 43A and 43B through the first and second water-supplying holes, respectively. Water supplied to the first and second ice trays 43A and 43B are contained in the respective ice making recesses 44A and 44B. In this way, water contained in the ice making recesses 44A and 44B is frozen by cold air flowing through the freezing chamber, thereby making ice. At this time, the cold air can be more efficiently delivered to the first and second ice trays 43A and 43B through the cold air supply openings 19.

When water contained in the ice making recesses 44A and 44B is frozen and ice is made, the manipulating levers 42A and 42B are manipulated so that the first and second ice trays 43A and 43B are rotated. Furthermore, when the first and second ice trays 43A and 43B are rotated and twisted by a predetermined angle, ice made in the ice making recesses 44A and 44B is separated. At this time, as the first and second tray covers 45A and 45B are rotated in response to the rotation of the first and second ice trays 43A and 43B the ice making recesses 44A and 44B are opened.

The ice separated from the ice making recesses 44A and 44B in such a manner is stored in the ice bank 50 provided below the first and second ice trays 43A and 43B. Furthermore, when the ice bank 50 is taken out from the ice making space, it is possible to use ice stored therein.

It will be apparent that those skilled in the art can make various modifications and changes thereto within the fundamental technical spirit of the present invention. The scope of the present invention should be construed on the basis of the appended claims.

Mode for Invention

Next, an ice making device for a refrigerator according to another embodiment of the present invention will be described in detail with reference to the accompanying drawings.

Figure 5:
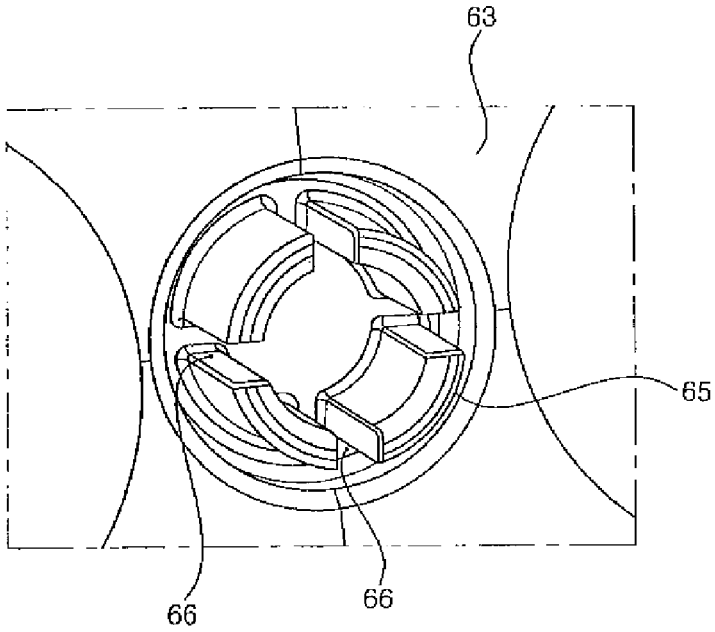
FIG. 5 is a perspective view illustrating a driving unit in an ice making device for a refrigerator according to another embodiment of the present invention.
Figure 6:
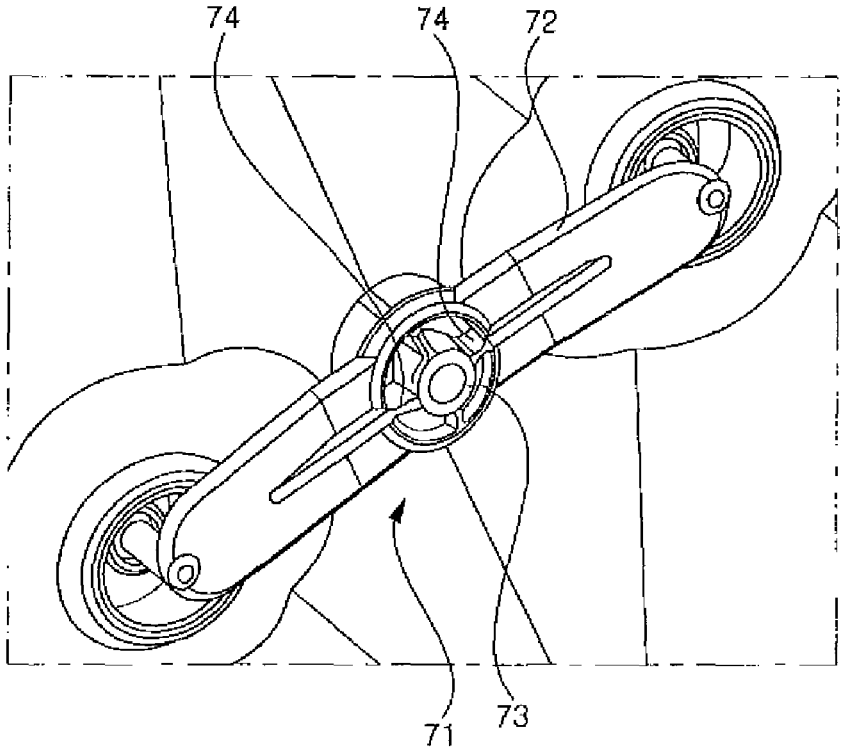
FIG. 6 is a perspective view illustrating a valve in an ice making device for a refrigerator according to a further embodiment of the present invention.

FIG. 5 is a perspective view illustrating a driving unit in an ice making device for a refrigerator according to another embodiment of the present invention, and FIG. 6 is a perspective view illustrating a valve in an ice making device for a refrigerator according to a further embodiment of the present invention.

In this embodiment, a driving unit 63 and a valve body 72 are provided with a driving boss 65 and a driving protrusion 73, respectively, in order to more accurately drive a valve 71 by the driving unit 63. The driving boss 65 protrudes upwardly by a predetermined height from a top surface of the driving unit 63. Furthermore, the driving protrusion 73 protrudes downwardly by a predetermined height from a bottom surface of the valve body 72. In the process of driving the valve 71 by the driving unit 63, the driving protrusion 73 is inserted into the driving boss 65. At this time, it is preferred that an inner peripheral surface of the driving boss 65 and an outer peripheral surface of the driving protrusion 73 be in surface contact with each other.

Furthermore, the driving boss 65 is provided with guide slits 66, and the driving protrusion 73 is provided with guide ribs 74. The guide slits 66 are formed by partially cutting out the outer peripheral surface of the driving boss 65 in a vertical direction. Furthermore, the guide ribs 74 are formed by radially extending portions of the outer peripheral surface of the driving protrusion 73. In the process of driving the valve 71 by the driving unit 63, i.e., in the process of inserting the driving protrusion 73 into the driving boss 65, the guide ribs 74 are inserted into the guide slits 66 so that the driving protrusion 73 can be accurately inserted into the driving boss 65.

INDUSTRIAL APPLICABILITY

With the ice making device for a refrigerator according to the present invention thus constructed, it can be expected to obtain the following advantages.

According to the present invention, water stored in the water tank is supplied to the ice trays and ice is then made. Hence, water can be more simply supplied to the ice trays, and thus, it is possible for a user to make ice more conveniently.

Furthermore, according to the present invention, water stored in the water tank is supplied to the ice trays in a state where the ice trays are mounted in a storage space of the refrigerator. Hence, in the process of supplying the water stored in the water tank to the ice trays, it is possible to prevent water from being splashed to the outside, whereby the ice making device can be used more cleanly.

Moreover, according to the present invention, water stored in the water tank is supplied to the ice trays through the water-supplying opening, the water-supplying holes and the water-supplying apertures. Hence, in the process of supplying the water stored in the water tank to the ice trays, it is possible to prevent the water from penetrating into the exterior of the ice trays, i.e., a rotation mechanism for rotating the ice trays, and from being frozen to interrupt the rotation of the ice trays, thereby improving the operational reliability of a product.

The invention claimed is:

1. An ice making device for a refrigerator, the ice making device being installed in a storage space of the refrigerator to make ice by cold air circulating through the storage space, the ice making device comprising:

a water tank installed within an ice making space provided in a receiving box that is installed to be introduced into and taken out from the storage space, the water tank having a water-storing space for storing water to be used in making ice and at least one water-supplying hole for supplying the water stored in the water-storing space;

a housing within the receiving box;

at least one ice tray installed in the ice making space and provided with at least one ice making recess for making ice by receiving the water stored in the water-storing space; and a fixing means for preventing the water tank from being inadvertently released from a state where the water tank is mounted in the ice making space, wherein the water stored in the water tank is supplied to the ice tray when the water tank is mounted in the storage space, wherein the water tank is supported by a support plate provided in the ice making space, the support plate forming a top surface of the housing, wherein the support plate is provided with a plurality of cold air supply openings formed by cutting out a portion of the support plate for causing cold air circulating through the storage space to flow into the ice making space, and wherein the water tank is installed in the ice making space such that the water tank can be detachably attached in a vertical direction, and the ice tray is installed in the ice making space below the water tank such that the ice tray can be introduced into and taken out from the ice making space in a fore and aft direction.

2. The ice making device as claimed in claim 1, wherein the water tank comprises:

a tank body having the water-storing space and the water-supplying hole;

a tank cover for selectively opening and closing the water-storing space; and a valve for selectively opening and closing the water-supplying hole.

3. The ice making device as claimed in claim 2, wherein the valve comprises:

a valve body installed on a bottom surface of the tank body so as to move in a vertical direction;

at least one valve protrusion provided in the valve body such that an upper end of the valve protrusion penetrates through the bottom surface of the tank body and is then positioned within the water-storing space;

at least one valve cap provided on the upper end of the valve protrusion positioned within the water-storing space so as to selectively open and close the water-supplying hole; and an elastic member for imparting an elastic force to the valve body, the elastic force being applied in a direction for closing the water-supplying hole by the valve cap, and wherein when the water tank is mounted in the storage space, the valve is moved while overcoming the elastic force of the elastic member and then opens the water-supplying hole.

4. The ice making device as claimed in claim 3, wherein the water supplied to the ice tray through the water-supplying hole is transferred to the ice tray through a water-supplying opening that is formed in the support plate to support the water tank.

5. The ice making device as claimed in claim 3, wherein when the water tank is mounted in the ice making space, the valve opens the water-supplying hole while being moved in the vertical direction by a driving unit provided on the support plate to support the water tank.

6. The ice making device as claimed in claim 5, wherein corresponding portions of the driving unit and the valve are provided respectively with a driving boss and a driving protrusion that are formed to match with each other in shape such that the driving protrusion is inserted into the driving boss.

7. The ice making device as claimed in claim 6, wherein corresponding portions of the driving boss and the driving protrusion are provided respectively with a guide slit and a guide rib for guiding the insertion between the driving boss and the driving protrusion.

8. The ice making device as claimed in claim 7, wherein the guide slit is formed by cutting out a portion of an outer peripheral surface of the driving boss in a lengthwise direction of the driving boss, and the guide rib is formed by radially extending a portion of an outer peripheral surface of the driving protrusion.

9. The ice making device as claimed in claim 1, wherein the fixing means comprises:

at least one fixing slot provided in one of the water tank and the support plate to support the water tank; and at least one fixing rib provided in the other of the water tank and the support plate so as to be inserted into the fixing slot.

10. The ice making device as claimed in claim 1, wherein the fixing means comprises:

at least one locking protrusion provided in one of the water tank and the support plate to support the water tank; and at least one fixing hook provided in the other of the water tank and the support plate so as to be elastically coupled to the locking protrusion.

11. The ice making device as claimed in claim 1, wherein the ice tray is rotatably installed on a support frame detachably attached in the ice making space.

12. The ice making device as claimed in claim 11, further comprising at least one tray cover for selectively opening and closing the ice making recess.

13. The ice making device as claimed in claim 12, wherein the tray cover selectively opens and closes the ice making recess in such a manner that one end of the tray cover is pivoted on the ice tray in response to rotation of the ice tray.

14. The ice making device as claimed in claim 13, wherein the tray cover is provided with a water-supplying aperture for transferring water to be supplied to the ice tray through the water-supplying hole to the ice tray.

15. The ice making device as claimed in claim 14, wherein a top surface of the tray cover is provided, in the vicinity of the water-supplying aperture, with a water-supplying guide for guiding the water to be supplied to the ice tray.

16. The ice making device as claimed in claim 1, further comprising an ice bank for storing ice made in the ice tray.

17. The ice making device as claimed in claim 16, wherein the ice bank is installed to be introduced into and taken out from the ice making space below the ice tray.

* * * * *